US005275579A

United States Patent [19]

Wilkinson

[11] Patent Number: 5,275,579

[45] Date of Patent: Jan. 4, 1994

[54] AEROBIC CLIMBING STEP/BENCH

[76] Inventor: William T. Wilkinson, Crownsville, Md.

[21] Appl. No.: 967,711

[22] Filed: Oct. 28, 1992

Related U.S. Application Data

[60] Continuation-in-part of Ser. No. 698,382, May 10, 1991, Pat. No. 5,184,987, and Ser. No. 754,075, Sep. 3, 1991, Pat. No. 5,162,028, and Ser. No. 891,178, May 29, 1992, which is a division of Ser. No. 718,754, Jun. 21, 1991, Pat. No. 5,118,096, which is a division of Ser. No. 588,449, Sep. 26, 1990, abandoned.

[51] Int. Cl.[5] ..... A63B 5/00

[52] U.S. Cl. ..... 482/52; 482/51; 248/157; 297/423.45

[58] Field of Search ..... 482/51, 52; 248/161, 248/157X; 297/439X

[56] References Cited

U.S. PATENT DOCUMENTS

| | | | |
|---|---|---|---|
| 3,865,050 | 2/1975 | Cecchetti | 248/188 X |
| 4,228,745 | 10/1980 | Gale | 297/439 |
| 4,659,075 | 4/1987 | Wilkinson | 482/52 |
| 5,125,646 | 6/1992 | Wilkinson | 482/52 |
| 5,158,512 | 10/1992 | Irwin et al. | 482/52 |
| 5,169,360 | 12/1992 | Saunders | 482/52 |

*Primary Examiner*—Gene Mancene
*Assistant Examiner*—L. Thomas
*Attorney, Agent, or Firm*—Connolly & Hutz

[57] ABSTRACT

An aerobic climbing step/bench includes a base in the form of a horizontal platform having a downwardly extending apron. Height adjustability is achieved by the use of detachable legs which are mounted to the base by the interengagement of mounting elements on each leg and complementary mounting elements on the base so that the legs can be slideably engaged in a locking position with the base and slideably detached from the base.

19 Claims, 5 Drawing Sheets

AEROBIC CLIMBING STEP/BENCH

CROSS-REFERENCE TO RELATED APPLICATIONS this application is a continuation-in-part of application Ser. No. 07/698,382, filed May 10, 1991, now U.S. Pat. No. 5,184,987, and application Ser. No. 07/754,075, filed Sep. 3, 1991, now U.S. Pat. No. 5,162,028. This application is also a continuation-in-part of application Ser. No. 07/891,178, filed May 29, 1992, pending which in turn is a division of application Ser. No. 07/718,754, now U.S. Pat. No. 5,118,096 filed Jun. 21, 1991, which in turn is a division of application Ser. No. 07/588,449, filed Sep. 26, 1990 now abandoned.

BACKGROUND OF INVENTION

Various devices exist for use in aerobic exercise programs. One type of device which has met with great success is a bench or step for aerobic step climbing. For example, I have developed a form of single step climbing during which the user would repeatedly step up and down from a single step. An important feature for making the device capable for widespread appeal to permit it to be customized to the needs of the particular user is height adjustability. In my U.S. Pat. No. 4,340,218 disclose one manner of achieving this height adjustability. Other later patents and applications of mine disclose useful variations for accomplishing that result.

SUMMARY OF INVENTION

An object of this invention is to provide an aerobic climbing step/bench which is compact and lightweight and capable of being stored and transported.

A further object of this invention is to provide such a device which may offer a wide variety of incremental heights that are easily and quickly adjustable to accommodate the needs of a particular user.

A further object of this invention is to provide such a device which may be mass produced inexpensively in a simple design.

In accordance with one embodiment of this invention, the aerobic climbing step/bench device includes a base which is in the form of a horizontal platform having a downwardly extending apron. Height adjustability is achieved by the provision of legs which include mounting elements for engagement with complementary mounting elements on the base. In one practice of the invention, the engagement is achieved by a horizontal, sliding engagement of the legs into and out of their mounting position.

The legs and base may include multiple sets of mounting elements so that height adjustment is achieved in accordance with the sets of mounting elements being utilized. Alternatively, height adjustment could be achieved by providing plural sets of legs which are attached to each other to raise or lower the platform. A mat may also be provided which could be used for the lowest height in an aerobic exercise program or could be used for achieving the greatest height by placing the base and its attached legs on top of the mat.

THE DRAWING

DETAILED DESCRIPTION

Figure 1:
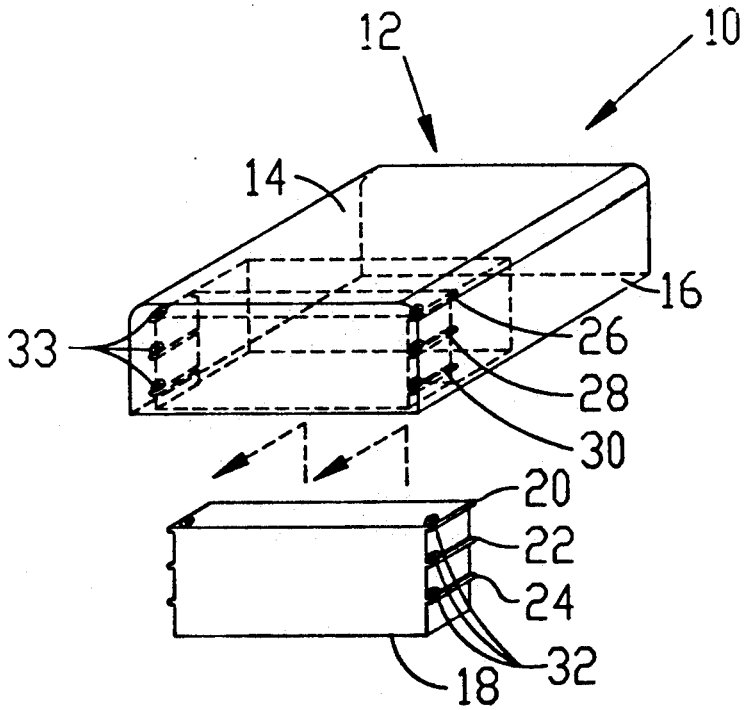
FIG. 1 is a perspective assembly view showing an aerobic climbing step/bench in accordance with my invention wherein one of a pair of legs is to be mounted to a base.

FIG. 1 illustrates an aerobic climbing step/bench device 10 in accordance with this invention. As shown therein device 10 includes a base 12 having a horizontal platform 14 with a downwardly extending apron 16. Apron 16 may extend completely around the periphery of platform 14 or may extend only in areas where support is needed. As shown in FIG. 1 height adjustability is achieved through a pair of steps 18 only one of which is illustrated. The other step would be of identical construction. Step 18 is provided with a series of vertically displaced mounting elements 20, 22, 24 on each side thereof. In the illustrated embodiment the mounting elements are in the form of ridges or tongues which fit in corresponding grooves or tracks on opposite sides 26, 28, 30 on the inner surface of apron 16. One set of such grooves or tracks is illustrated at one end of apron 16 and a second set would be provided at the other end of apron 16. Each leg 18 is of a length which is no greater than ⅓ the length of base 14 so that the corresponding tracks 26, 28, 30 could extend at each end of apron 16 and occupy about a ⅓ of its length in each location thereof. Thus, a central portion of apron 16 is free of tracks so that each leg may be mounted to base 12 by being inserted upwardly in the central portion of the base between the opposite sides of apron 16. Base 12 is preferably inverted to permit the legs to be mounted. Alternatively, base 12 could be raised without inversion and each leg sequentially moved vertically into the trackless central section of apron 16. Each leg 18 Would then be moved outwardly toward the outer end of platform 14 with the various ridges engaged in the complementary tracks of base 12. Preferably, each ridge is provided with a projection such as a nub or dimple 32 which would fit in a corresponding notch 33 in its respective track to lock the leg in place when the leg is disposed at its most outward position. In the preferred practice of this invention a pair of legs 18 would be provided for base 12. The invention, however, may be practiced with any number of legs as long as the desired stability is achieved.

Figure 3:
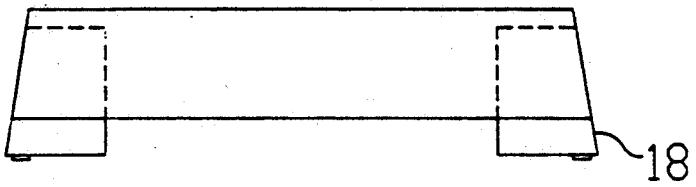
Figure 4:
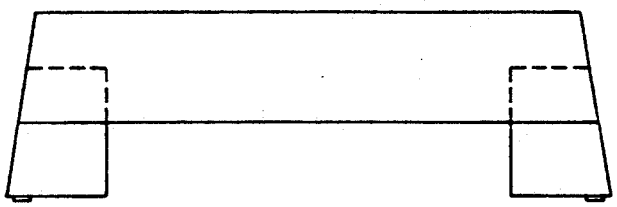
Figure 5:
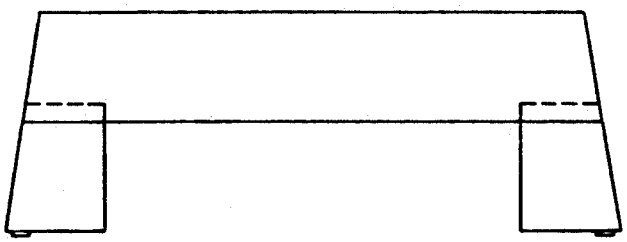
Figure 6:
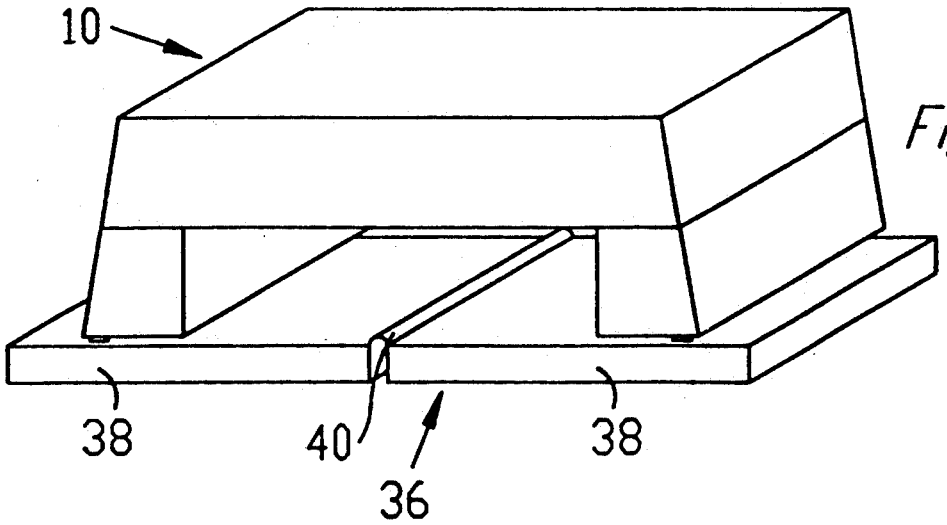
FIG. 6 is a perspective view of the device shown in FIGS. 1–5 at its maximum height.

Height adjustment is attained by selecting which of the tracks the leg ridges are mounted into. For example, FIG. 3 illustrates one elevation where each ridge 20, 22, 24 is mounted in a corresponding track 26, 28, 30 so that the legs 18 are inserted their maximum distance into base 12. FIG. 4 illustrates the next height level where ridges 20, 22 would be engaged with tracks 28, 30. FIG. 5 illustrates ridges 20 to be engaged with tracks 30 to achieve yet another height wherein the legs are extended away from platform 14 by their maximum amount.

If desired, nonskid members 34 could provided on the surface contacting edges of apron 16 and legs 18. Similarly, a nonskid surface could be on the upper portion of platform 14.

Figure 8:
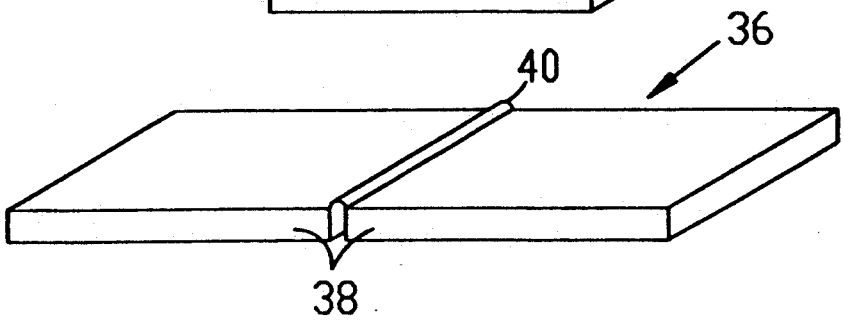
FIG. 8 is a perspective view showing the mat from FIGS. 6–7 in its opened and flat condition.

In order to achieve maximum height versatility device 10 further includes a mat 36 which preferably is made of at least two panels 38 with each set of adjacent panels connected together by a flexible hinge 40. FIG. 8 illustrates mat 36 in its opened position which would correspond to the lowest height for the exercise device wherein the base 12 and legs 18 would not be utilized.

Figure 2:
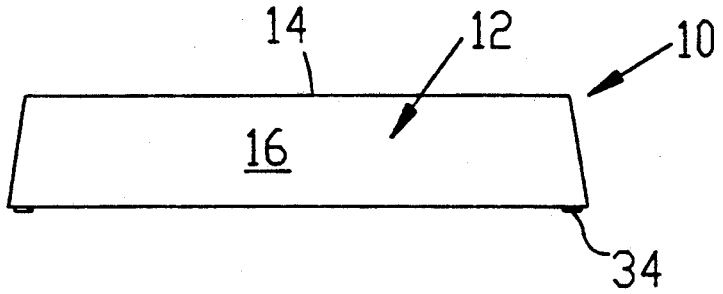
FIGS. 2–5 are front elevational views of an aerobic climbing step/bench device in accordance with this invention shown at different heights.
Figure 7:
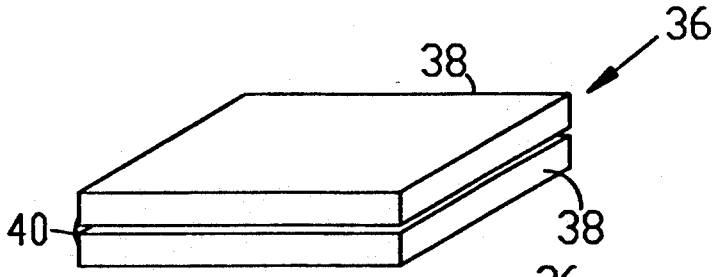
FIG. 7 is a perspective view showing the mat from FIG. 6 in its folded condition.

In one practice of this invention, mat 36 is two inches high. Platform 14 extends above the lower edge of apron 16 by a height of six inches. The various ridges are spaced two inches apart. With these dimensions it is possible to achieve a range of height adjustment from two inches to fourteen inches in two inch increments. FIG. 8, for example, shows mat 36 in its opened condition wherein a step is formed two inches high. At this height mat 36 could be a low step or a warmup mat. When mat 36 is folded over to the position shown in FIG. 7 the mat is four inches high which would correspond to the second elevation for the step. FIG. 2 illustrates the device wherein the base 12 itself is used as the step without any mat or without any legs. In FIG. 2 the step would be six inches high. Where legs 18 are mounted to base 12 and are fully inserted therein so as to extend two inches below the lower edge of apron 16 the height of the resulting step is eight inches high. FIG. 4 shows the next height of ten inches where two of the three sets of ridges are utilized for mounting purposes. FIG. 5 shows an elevation of twelve inches where legs 18 are fully extended. The final height of fourteen inches is achieved by placing the assembly of FIG. 5 on the mat 36 so as to raise platform 14 to an elevation of fourteen inches. To accomplish this, mat 36 has an area larger than the area of base 12. It is to be understood that the above dimensions are merely exemplary. For example, the invention could be practiced with a greater or lesser number of sets of ridges and tracks which are spaced apart by distances other than two inches. Such arrangement would change the height selectively. Similarly, the dimensions of mat 36 and base 12 would also affect the height adjustability.

Where mat 36 is made of two or more panels, different heights could be achieved by the degree the panels are folded atop each other, with the panels alone comprising the step or with the base be placed on the unfolded or folded mat.

Figure 9:
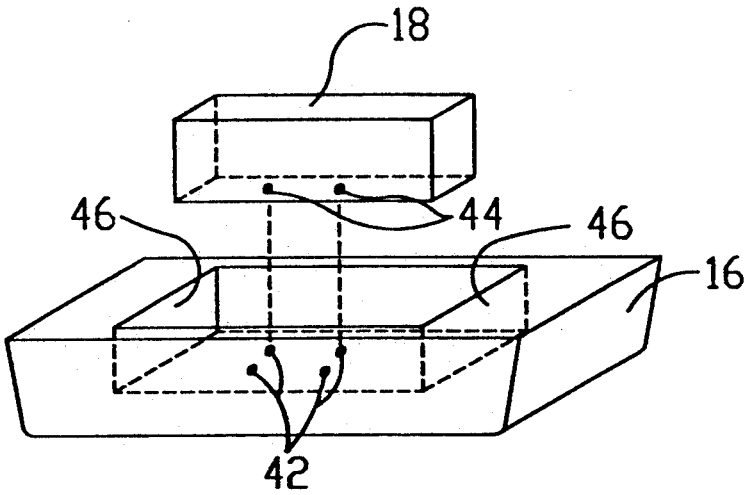
FIG. 9 is a perspective view showing the manner of storing one of the legs in the base in accordance with one embodiment of this invention.

Another advantageous feature of this invention is the ability to store the legs and mat during periods of nonuse of those components. FIG. 9, for example, illustrates base 12 to be in an inverted position. Two sets of posts 42 are provided on the under surface of platform for accommodating the corresponding holes 44 into legs 18 when each leg is moved downwardly into contact with the under surface of the inverted base 12.

FIG. 9 illustrates a variation of the invention wherein an inner apron 46 is provided with sides parallel to outer apron 16. The inner apron 46 could be dimensions for snugly receiving the two legs 18 or the folded mat 36. Mounting elements could be provided on outer surface of inner apron 46 to cooperate with corresponding mounting elements on the adjacent inner surface of apron 16. Where the legs are center mounted as in FIG. 1, the mounting elements would be on the front and back walls of apron 46 and four legs would be used. Where the legs are front mounted as later described with respect to FIG. 13, the mounting elements would be on the end walls of inner apron 46.

Figure 10:
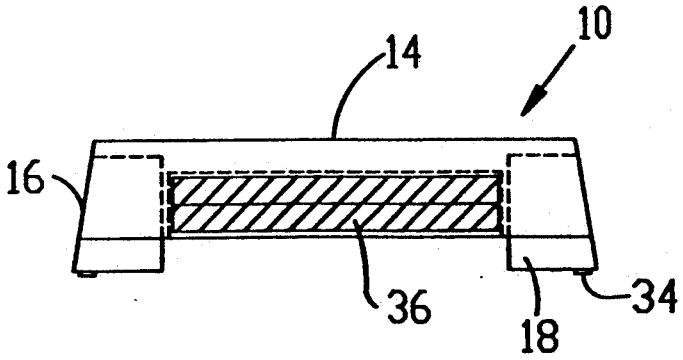
FIG. 10 is a side elevational view partly in section showing the mat of FIGS. 6–8 in a stored condition.

FIG. 10 illustrates mat 36 to be folded over and stored within the periphery of inner apron 46 during periods where the mat is not used.

Figure 11:
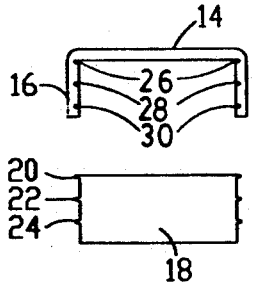
FIGS. 11–12 are end elevational views showing alternative structures for the aerobic climbing step/bench device of this invention.
Figure 12:
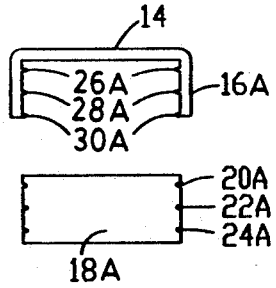

FIGS. 11-12 illustrate alternative arrangements for the complementary locking of the legs 18 to the base. As shown in FIG. 11 the legs 18 include outwardly extending ridges 20, 22, 24 while the inner surface of apron 16 includes tracks 26, 28, and 30. FIG. 12, however, illustrates leg 18A to include tracks 20A, 22A, and 24A while the ridges 26A, 28A and 30A are provided on the inner surface of apron 16A.

Figure 13:
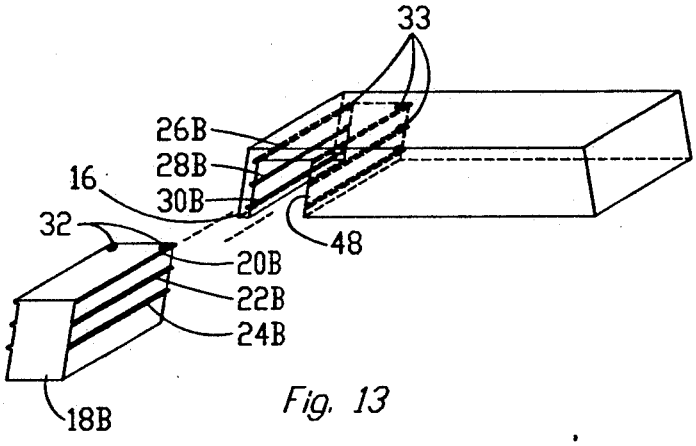
FIGS 13–16 are perspective views showing alternative arrangements for achieving height adjustability for the aerobic climbing step/bench in accordance with alternative forms of this invention.

FIG. 13 illustrates a variation of the invention wherein the legs 18B are front mounted rather than being inserted into the center of base 12 and then being moved outwardly in the manner described with respect to FIG. 1. As illustrated in FIG. 13, legs 18B include ridges 20B, 22B, 24B which engage complementary tracks 26B, 28B, 30B along the surface of apron 16 and inner apron 48. Inner apron 48 in this embodiment is a wall parallel to one of the end walls of apron 16 so that the leg 18B may be inserted by being slid through the open area in the front wall of apron 16 with the corresponding ridges engaged in complementary tracks. A second inner apron and mounting elements would be at the opposite end of the base along with a second opening in the front of the apron. When fully inserted, leg 18B is locked in place by the projections 32B entering corresponding notches in the complementary tracks.

Figure 14:
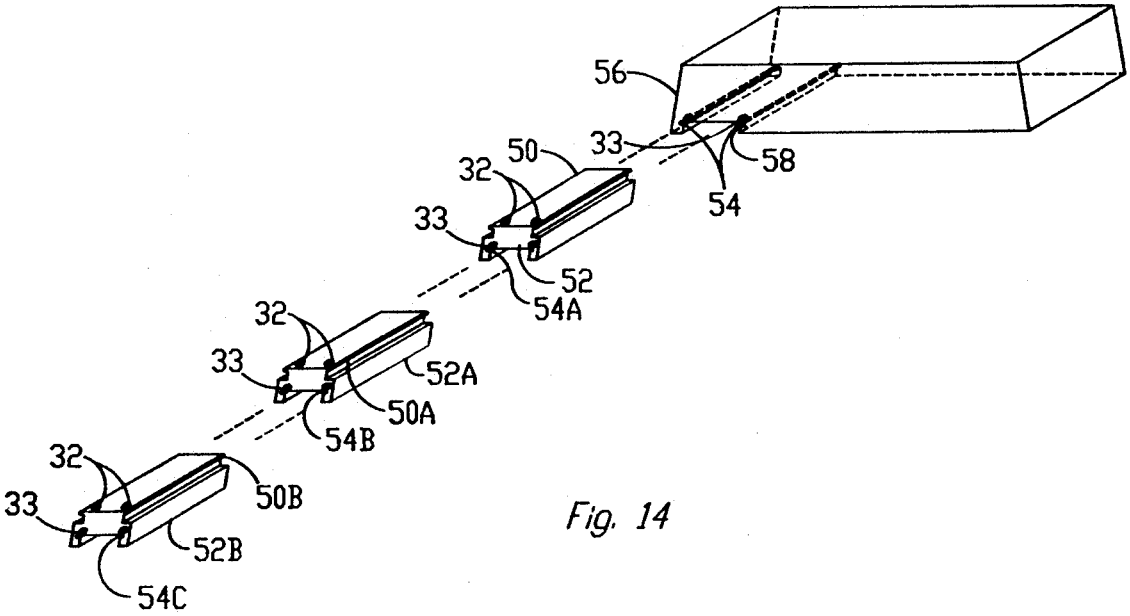

FIG. 14 illustrates a further variation of this invention wherein height adjustability is achieved by having a single set of fastening elements such as ridges 50 on leg 52. Ridges 50 engage in corresponding tracks 54 provided in outer apron 56 and inner wall 58. Leg 52 would be front mounted in the manner similar to leg 18B except that there is no selectivity for height adjustment of leg 52. In this respect, there is only a single set of tracks and a single set of ridges. Height adjustment is achieved by providing further legs 52A, 52B, etc. each of which has a set of ridges 50A, 50B, etc. for engagement in complementary tracks 54A, 54B, etc. to selectively permit any number of legs to be vertically connected together. For example, as illustrated lower leg 52B includes a track 54C for receiving yet another leg. It is to be understood that although the various figures illustrate only a single leg mounted to the respective base, the invention would be practiced by having legs at at least two spaced locations, preferably at the opposite ends of the base.

Figure 15:
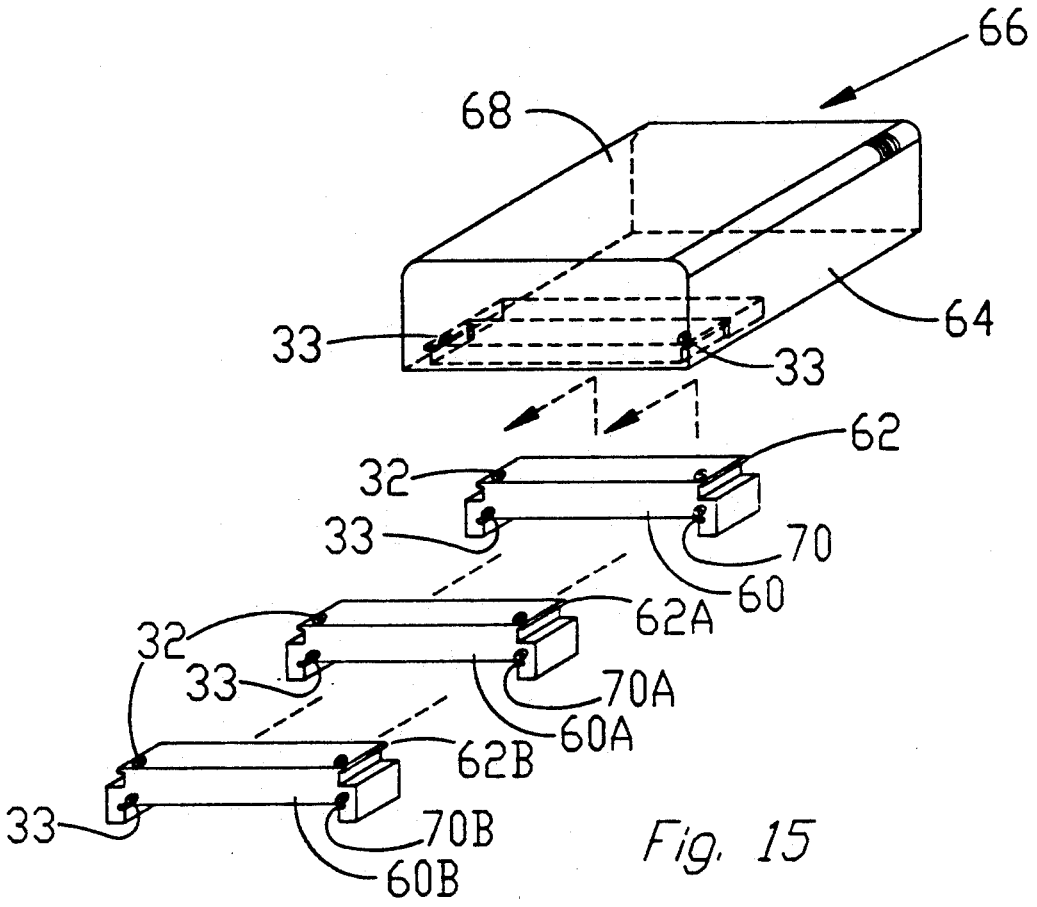

FIG. 15 illustrates a variation wherein the concepts of FIGS. 1 and FIGS. 14 are combined. In this respect, a set of legs 60, 60A, 60B, etc. are provided which include ridges 62, 62A, 62B, etc. The ridges 62 engage tracks at opposite sides of apron 64 by leg 60 being inserted in the same manner as leg 18. In this respect, leg 60 is positioned at generally the center of base 66 and moved toward platform 68 until its ridges 62 are aligned with the ridges on the inner surface of apron 64. Leg 60 is then moved outwardly with the ridges 62 sliding in the tracks until the legs are locked in place by the use of projections and notches as previously described. When further height adjustment is desired, a second leg 60A is slideably secured to leg 60 by ridges 62A engaging track 70 in leg 60. A similar locking action of a projection and notch would also be utilized to firmly lock leg 60A to leg 60. A third leg 60B could then be secured to the assembly by its ridges 62B engaging tracks 70A of leg 60A. Any number of legs could be vertically secured together in this manner.

Figure 16:
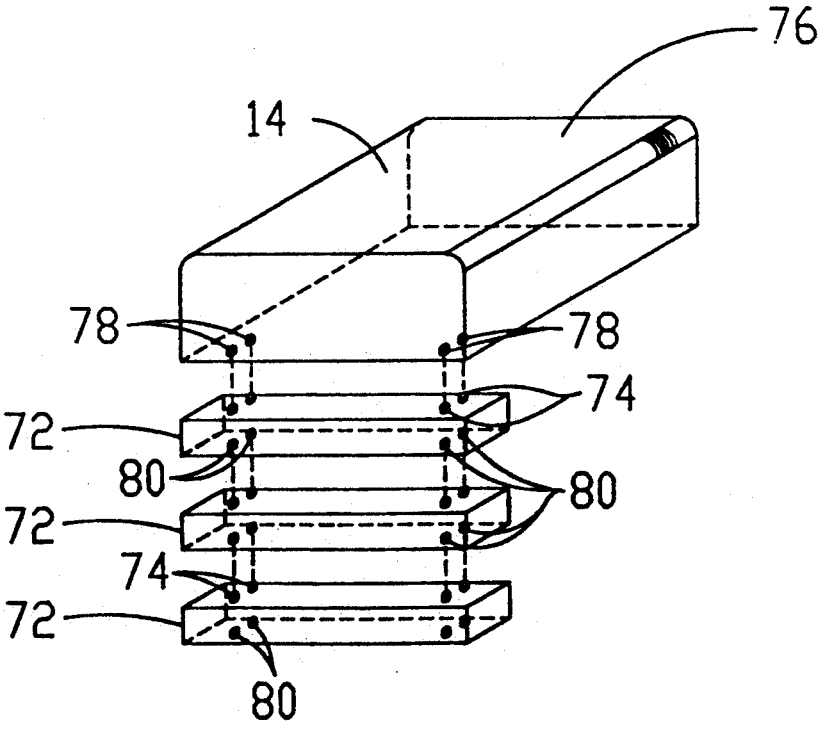

FIG. 16 illustrates a further variation of the invention wherein the legs are in the form of identical block members 72. Each block 72 includes sets of posts 74. Base 76 is formed of solid block construction and its lower surface is provided with sets of holes 78 positioned for snugly receiving posts 74 from the uppermost leg 72. Each leg in turn gets provided with holes 80 at its lower surface for receiving the posts 74 of the next adjacent lower leg 72. This manner of height adjustment is particularly advantageous since the interlocking of the posts and holes provides a positive support structure which would prevent any accidental dislodgement of legs by someone inadvertently for example kicking the assembly.

If desired base 76 may be of solid block construction only in the areas where the legs are secured to the base.

It is to be understood that each of the above described embodiments may be incorporated with other of the embodiments. For example, the inner apron may take various forms where such an inner apron is used. In one form, the inner apron may comprise a wall disposed inwardly and parallel to one of the outer apron walls which extends completely across the base. Alternatively, the inner apron may be comprised of four walls forming a closed rectangle wherein each inner wall is parallel to and spaced from a corresponding outer apron wall. The apron itself may be perpendicular to the platform or may be disposed at an angle. Likewise the inner apron would be parallel to the outer apron, either perpendicular or at an angle to the platform. The legs may generally be mounted to the base in one of two manners. In one practice a leg is center mounted by being inserted in generally the central area of the base and moved outwardly with the ridges and tracks forming complementary mounting means. In the other practice, the legs are front mounted by being inserted from the front side of the apron toward the opposite rear face. In such practice, the apron would be physically located so that the leg abuts against an apron wall even if other portions of the apron have open spaces.

Where a mat is used the base, legs and mat are dimensioned in the preferred practice of the invention to provide for storage of the mat within the base during periods of nonuse of the mat. For example, the base may be sixteen inches by thirty-two inches by six inches with the legs having a length of six inches thereby forming an open space between the legs twenty inches long. The mat itself in its opened condition would be two inches by sixteen inches by forty inches so that in its folded condition it would be twenty inches long for snugly fitting in the space between the legs.

While various embodiments have been described with respect to ridges or tracks being formed on the apron, it is to be understood that the invention may be broadly practiced by providing the ridges for tracks on the undersurface on the platform itself rather than on the apron. For example, the undersurface of the platform might be inclined so that ridges or tracks located parallel to each other at different differences to the periphery of the platform would cause different height elevations when the ridges or tracks are engaged by complementary tracks or ridges on the top surface of the legs.

The invention may be practiced wherein the legs at each end of the device are connected together so that the legs are in the form of a single unitary block mounted to and below the base.

The invention may also be practiced incorporating the various width and height adjustment techniques disclosed in parent application Ser. No. 07/754,075 filed Sep. 3, 1991, the details of which are incorporated herein by reference thereto.

What is claimed is:

1. An aerobic climbing step/bench device comprising a base, said base consisting of a horizontal platform having a periphery formed by opposite ends and intermediate sides with a downwardly extending apron, at least two sets of mounting members in said base, each of said sets of mounting members comprising at least one member associated with said base at opposite portions of said periphery, a leg for each of said sets of mounting members, each of said legs having complementary mounting members for sliding engagement with said mounting members whereby each of said legs may be selectively deteachably mounted to said base to provide said platform with at least two levels of height adjustability ranging from a low height when said apron is placed directly on a support surface and wherein there is at least one other height level in accordance with the selective mounting of said mounting members, each of said sets of mounting members comprising at least two vertically parallel members, said mounting members and complementary mounting members being selectively tracks and ridges or ridges and tracks, said mounting members being associated with the inner surface of said apron on said opposite intermediate sides thereof near the ends of said periphery, and said legs being inserted into the central portion of said base until said mounting members and complementary mounting members are aligned whereupon each of said legs may be in sliding engagement with said apron to slide each of said leg toward its respective end of said periphery.

2. The device of claim 1 wherein there are at least three mounting members and complementary mounting members in each of said sets, and each of said sets including two aligned members.

3. The device of claim 2 including a mat, said mat being dimensioned to be at least as large in area as said base whereby said mat provides at least one additional height adjustments by use of said mat alone and by the mounting of said base upon said mat.

4. The device of claim 3 wherein said mat comprises at least two panels with each set of adjacent panels joined by a flexible hinge.

5. The device of claim 4 wherein each of said panels is a size to permit said mat to be folded and inserted within said apron in the space between said legs when said mat is in its nonuse storage condition.

6. The device of claim 3 wherein said device provides a step/bench having height resulting adjustability in the range of two inches to fourteen inches.

7. The device of claim 6 wherein said height adjustability includes a two inch height when said mat is used as said step/bench in its unfolded condition, a second position of four inch height resulting when said mat is used in its folded condition a third position of six inch height when said base is used as said step/bench without any legs, fourth, fifth and sixth positions of eight, ten and twelve inch heights resulting in accordance with the selective engagement of said mounting members and said complementary mounting members and a seventh position of fourteen inch height resulting when said base and said legs are positioned on said mat when said mat is on its unfolded condition.

8. The device of claim 7 wherein said mounting members and said complementary mounting members include complementary projections and notches for locking said legs in place.

9. The device of claim 1 wherein said mounting members and said complementary mounting members include complementary projections and notches for locking said legs in place.

10. An aerobic climbing step/bench device comprising a base, said base consisting of a horizontal platform having a periphery formed by opposite ends and intermediate sides with a downwardly extending apron, at least two sets of mounting members in said base, each of said sets of mounting members comprising at least one member associated with said base at opposite portions of said periphery, a leg for each of said sets of mounting members, each of said legs having complementary mounting members for sliding engagement with said mounting members whereby each of said legs may be selectively detachably mounted to said base to provide said platform with at least two levels of height adjustability ranging from a low height when said apron is placed directly on a support surface and wherein there is at least one other height level in accordance with the selective mounting of said mounting members, each of said sets of mounting members comprising at least two vertically parallel members, said mounting members and complementary mounting members being selectively tracks and ridges or ridges and tracks, said apron being an outer apron, and said base including an inner apron having walls parallel to and spaced from corresponding walls of said outer apron, said mounting members being on said walls of said inner apron and said outer apron, said outer apron having an opening in one of said intermediate walls and being closed at the opposite portion of its opposite intermediate wall whereby said legs may be mounted through said opening in said intermediate wall.

11. The device of claim 1 wherein said mounting members and said complementary mounting members include complementary projections and notches for locking said legs in place.

12. An aerobic climbing step/bench device comprising a base, said base consisting of the horizontal platform having a periphery formed by opposite ends an intermediate sides and said base having downwardly extending sides and a bottom surface, mounting members formed in said base by an opening forming two parallel walls upwardly from said bottom surface at two spaced locations of said base, a first set of legs for each of said locations, each of said first set of legs having complementary mounting members for engagement with aid mounting members of said base whereby said platform is provided with at least two levels of height adjustability wherein there is one height level when no leg is mounted to said base and said base is placed directly on a support surface and there is at least one other height level in accordance with said legs being mounted to said base, and said mounting members and complementary mounting members comprising ridges and tracks or tracks and ridges which are engaged with each other by a sliding movement of each of said legs between a respective set of said two parallel walls.

13. The device of claim 12 wherein projections and notches are provided on said mounting members and complementary mounting members for locking said legs in place.

14. The device of claim 12 wherein said pairs of walls and said legs include plural sets of mounting members and complementary mounting members to provide height adjustability in accordance with which mounting members and complementary mounting members are engaged.

15. The device of claim 12 wherein said legs comprise a first elevation set of legs, including a second elevation set of legs, said first set of legs having mounting members, and said second set of legs having complementary mounting members for selective engagement with said mounting members of said first set of legs to provide a further height level.

16. An aerobic climbing step/bench device comprising a base, said base consisting of a horizontal platform having a periphery formed by opposite ends and intermediate sides with a downwardly extending apron, said base having a pair of parallel generally vertically depending walls at opposite portions of said periphery, each of said pair of walls having inner surfaces disposed toward each other, at least one wall of each of said pair of walls being an inner surface of said apron, at least one of said inner surfaces of one of said pair of walls having mounting members in the form of tracks or ridges, a leg for each of said pair of walls, each of said legs having complementary mounting members in the form of tracks or ridges, at least one of said mounting and complementary mounting members being of elongated form, each of said legs being selectively detachably mounted to said base by slidably moving said leg with respect to its said pair of walls so that said mounting and complementary mounting members are in sliding engagement with each other to provide said platform with at least two levels of height adjustability ranging from a low height when said apron is placed directly on a support surface and wherein there is at least one other height level in accordance with the selective mounting of said mounting members, and said mounting and complementary mounting members being engaged by a sliding movement of said respective leg in a straight line direction.

17. The device of claim 15 wherein said pairs of walls and said legs include plural sets of mounting members and complementary mounting members to provide height adjustability in accordance with which mounting members and complementary mounting members are engaged.

18. The device of claim 15 wherein said legs comprise a first elevation set of legs, including a second elevation set of legs, said first set of legs having mounting members, and said second set of legs having complementary mounting members for selective engagement with said mounting members of said first set of legs to provide a further height level.

19. The device of claim 16 wherein said base includes a recessed portion extending beyond its mounting members to center mount said legs by permitting said legs to be disposed in said recess and slid into sliding engagement with said mounting members.

* * * * *